US006566411B2

(12) United States Patent
Moore, Jr. et al.

(10) Patent No.: US 6,566,411 B2
(45) Date of Patent: May 20, 2003

(54) REMOVING SULFUR FROM HYDROPROCESSED FISCHER-TROPSCH PRODUCTS

(75) Inventors: Richard O. Moore, Jr., San Rafael, CA (US); Roger D. Van Gelder, Beaconsfield (GB); Grant C. Hilton, Woking (GB); Clive Jones, Reading (GB)

(73) Assignee: Chevron U.S.A. Inc., San Ramon, CA (US)

( * ) Notice: Subject to any disclaimer, the term of this patent is extended or adjusted under 35 U.S.C. 154(b) by 75 days.

(21) Appl. No.: 09/789,143

(22) Filed: Feb. 20, 2001

(65) Prior Publication Data

US 2002/0115732 A1 Aug. 22, 2002

(51) Int. Cl.[7] ..... C07C 27/00; C10G 47/00; C10G 15/00; C10G 35/06; C10G 45/00

(52) U.S. Cl. ..... 518/700; 518/702; 218/58; 218/106; 218/137; 218/142; 218/208 R

(58) Field of Search ..... 518/700, 702; 208/58, 106, 137, 142, 208 R

(56) References Cited

U.S. PATENT DOCUMENTS 3,852,207 A 12/1974 Strangeland et al.
3,904,513 A 9/1975 Fischer et al.

(List continued on next page.)

FOREIGN PATENT DOCUMENTS

EP 0609079 8/1994
GB 2178756 A 2/1987

(List continued on next page.)

OTHER PUBLICATIONS

Beck, J., et al., "A New Family of Mesoporous Molecular Sieves Prepared with Liquid Crystal Templates", *J. Am. Chem. Soc.*, 114: 10834–10843 (1992) American Chemical Society, Washington, D.C.

(List continued on next page.)

*Primary Examiner*—J. Parsa
(74) *Attorney, Agent, or Firm*—Burns, Doane, Swecker & Mathis, L.L.P.

(57) ABSTRACT

An integrated process for producing desulfurized hydroprocessed products from Fischer-Tropsch synthesis is disclosed. The process involves isolating and desulfurizing a methane-rich stream from a natural gas source in a first separation zone and a desulfurization zone. The methane-rich stream is converted to syngas and subjected to a hydrocarbon synthesis step, for example, a Fischer-Tropsch synthesis step. The products from the hydrocarbon synthesis step typically include a $C_4$− fraction, a $C_{5-20}$ fraction, and a $C_{20}$+ wax fraction. These fractions are isolated in a second separation zone, typically via fractional distillation. The $C_4$− fraction can be recycled through the first separation zone to provide a second methane-rich fraction for conversion to synthesis gas. The $C_4$− fraction can optionally be treated, for example, with hydrotreatment or hydroisomerization catalysts and conditions before or after passage through the first separation zone. The hydrocarbons in the $C_{5-20}$ and $C_{20}$+ wax fractions are subjected to additional process steps, for example, hydrotreatment, hydroisomerization, hydrocracking (particularly in the case of the wax fraction), preferably in the presence of sulfur-containing compounds. The products of the additional process steps are sent to a third separation zone, and yield one or more fractions useful, for example, in fuel-related products (preferably $C_{5-20}$ hydrocarbons) as well as an additional C4− fraction. The additional C4− fraction, which can include sulfur impurities resulting from the hydroconversion reaction, can also be desulfurized in the desulfurization zone along with the natural gas. This eliminates the need for a second desulfurization zone. The desulfurization zone can be scaled up from its normal size, if desired, to accommodate the additional sulfur removal resulting from the hydroconversion.

12 Claims, 1 Drawing Sheet

U.S. PATENT DOCUMENTS

| | | | |
|---|---|---|---|
| 4,157,294 | A | 6/1979 | Iwao et al. |
| 4,347,121 | A | 8/1982 | Mayer et al. |
| 4,401,556 | A | 8/1983 | Bezman et al. |
| 4,568,663 | A | 2/1986 | Mauldin |
| 4,810,357 | A | 3/1989 | Chester et al. |
| 4,820,402 | A | 4/1989 | Partridge et al. |
| 4,913,799 | A | 4/1990 | Gortsema et al. |
| 5,059,567 | A | 10/1991 | Linsten et al. |
| 5,073,530 | A | 12/1991 | Bezman et al. |
| 5,114,563 | A | 5/1992 | Lok et al. |
| 5,162,282 | A | 11/1992 | Lopez et ajl. |
| 5,198,203 | A | 3/1993 | Kresge et al. |
| 5,246,689 | A | 9/1993 | Beck et al. |
| 5,334,368 | A | 8/1994 | Beck et al. |
| 5,750,819 | A | 5/1998 | Wittenbrink et al. |
| 5,852,061 | A | 12/1998 | Alexion et al. |
| 5,960,643 | A | 10/1999 | Kuechler et al. |
| 6,075,061 | A | 6/2000 | Wittenbrink et al. |
| 6,147,126 | A | 11/2000 | DeGeorge et al. |

FOREIGN PATENT DOCUMENTS

| | | | |
|---|---|---|---|
| JP | 59176388 | A | 10/1984 |
| WO | 99/13963 | | 3/1999 |
| WO | 99/37736 | | 7/1999 |
| WO | 99/37741 | | 7/1999 |
| WO | 00/00571 | | 1/2000 |

OTHER PUBLICATIONS

Kresge, C., et al., "Ordered mesoporous molecular sieves synthesized by a liquid–crystal template mechanism", *Nature*, 359: 710 (1992).

REMOVING SULFUR FROM HYDROPROCESSED FISCHER-TROPSCH PRODUCTS

FIELD OF THE INVENTION

This invention relates to the removal of sulfur from hydroprocessed Fischer-Tropsch products.

BACKGROUND OF THE INVENTION

The majority of fuel today is derived from crude oil. Crude oil is in limited supply, and fuel derived from crude oil tends to include nitrogen-containing compounds and sulfur-containing compounds, which are believed to cause environmental problems such as acid rain.

Although natural gas includes some nitrogen- and sulfur-containing compounds, methane can be readily isolated in relatively pure form from natural gas using known techniques. Many processes have been developed which can produce fuel compositions from methane. Most of these process involve the initial conversion of methane to synthesis gas ("syngas").

Fischer-Tropsch chemistry is typically used to convert the syngas to a product stream that includes a broad spectrum of products, ranging from methane to wax, which includes a significant amount of hydrocarbons in the distillate fuel range ($C_{5-20}$). Methane tends to be produced when chain growth probabilities are low. The methane can be recirculated through the syngas generator, but minimizing methane formation is generally preferred. Heavy products with a relatively high selectivity for wax are produced when chain growth probabilities are high. The resulting wax can be hydroconverted to form lower molecular weight products in the distillate fuel and lube base oil range.

The hydroconversion reactions typically include hydrotreatment, hydroisomerization and/or hydrocracking steps, designed to reduce the chain length and/or introduce isomerization. It is often more cost-effective to produce wax products and subject them to hydroprocessing conditions than to form product streams including significant amounts of methane.

The methane used to prepare the syngas used in the Fischer-Tropsch products is typically treated to remove sulfur, since sulfur is a poison for most Fischer-Tropsch catalysts. Accordingly, the products from the Fischer-Tropsch synthesis tend to have relatively low sulfur concentrations. However, the hydroprocessing reactions are often conducted in the presence of sulfur-containing compounds, for example, pre-sulfided catalysts. The hydroprocessing products must be treated to reduce the concentration of the sulfur-containing compounds.

Typically, the natural gas and the hydroprocessing products are treated at separate desulfurizing facilities. This adds to the expense of the overall process. It would be advantageous to provide new methods for removing sulfur from hydroprocessed Fischer-Tropsch products. The present invention provides such methods.

SUMMARY OF THE INVENTION

An integrated process for producing desulfurized hydroprocessed products from hydrocarbon synthesis, preferably Fischer-Tropsch synthesis, is disclosed. The process involves treating a well gas and isolating a desulfurized methane-rich fraction, a sulfur rich fraction and a $C_3$+ hydrocarbon fraction. The $C_3$+ fraction comprises an LPG stream (including mainly $C_{3-5}$ hydrocarbons) and a well gas condensate stream (primarily a $C_5$+ stream). The well gas, derived from a natural gas source, is treated in a treatment zone comprising a first separation zone and a desulfurizing zone.

The desulfurized methane-rich stream is converted to syngas and subjected to a hydrocarbon synthesis step, for example, a Fischer-Tropsch synthesis step. The products from the hydrocarbon synthesis step typically include a $C_1$–$C_4$ fraction, at least one low-boiling liquid fraction (generally in the $C_{5-20}$ range), and a high-boiling fraction such as wax ($C_{20}$+). These fractions are isolated in a second separation zone.

The $C_1$–$C_4$ fraction is recycled through the treatment zone, along with the well gas, for isolation of a desulfurized methane-rich fraction for conversion to synthesis gas.

The products from the hydrocarbon synthesis stem tend to be highly linear, and are preferably subjected to additional process steps for upgrading by one or more hydroconversion steps, including hydrotreatment, hydroisomerization, hydrocracking.

The hydroconversion preferably involves contacting the low-sulfur hydrocarbon synthesis products with sulfur-containing compounds such as pre-sulfided catalysts, and/or blending the products with other feed streams, such as petroleum refinery products which include sulfur-containing compounds, such that the hydroconversion products include a relatively higher concentration of sulfur than the hydrocarbon synthesis products. In one embodiment, the sulfur-containing compounds include natural gas liquids, crude oil fractions and/or sulfur-containing compounds derived from crude oil hydroconversion.

The products of the upgrading process are sent to a third separation zone for isolation of at least a gaseous fraction (primarily a $C_1$–$C_4$ fraction), at least one fuel fraction having a predominant fraction boiling in the $C_5$–$C_{20}$ range, and a heavy fraction which boils predominately in the $C_{20}$+ range. The $C_1$–$C_4$ fraction can also be sent to the treatment zone and treated in an analogous fashion to the $C_1$–$C_4$ fraction from the hydrocarbon synthesis.

Any sulfur-containing compounds resulting from the additional processing of the hydrocarbon synthesis products in hydroconversion reactions can be routed to the same desulfurization zone used to treat the sulfur-containing compounds in the natural gas, before or after passage through the first separation zone. This eliminates the need for a second desulfurization zone. Since most of the sulfur-containing compounds in the natural gas and hydroconversion products are relatively volatile (i.e., hydrogen sulfide and low molecular weight mercaptans), they will most likely be found in the $C_1$–$C_4$ fractions. The desulfurization zone can be scaled up from its normal size, if desired, to accommodate the additional sulfur removal resulting from the hydroconversion.

DETAILED DESCRIPTION OF THE INVENTION

Figure 1:
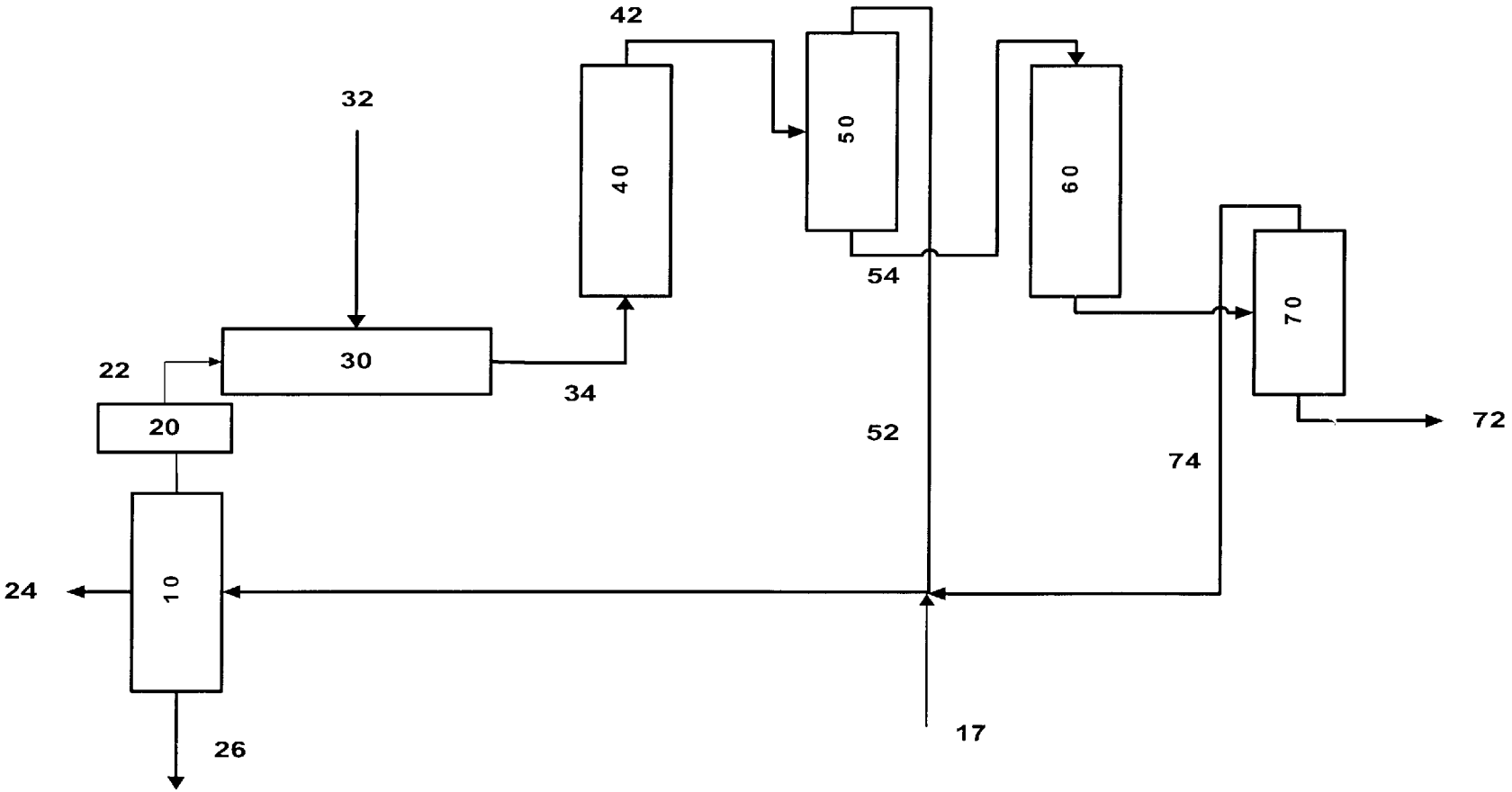
FIG. 1 is a schematic illustration of one embodiment of the process described herein.

An integrated process for producing desulfurized hydroprocessed products from hydrocarbon synthesis, preferably Fischer-Tropsch synthesis, is disclosed. A desulfurized methane-rich stream is isolated from natural gas in a first separation zone and a desulfurization zone, in any order, and then converted to syngas. The syngas is used in a hydrocarbon synthesis, preferably Fischer-Tropsch synthesis. The $C_5$+ products of the hydrocarbon synthesis are hydroprocessed, optionally after being separated into two or more separate fractions, and any sulfur-containing compounds resulting from the hydroconversion are treated in the same desulfurization zone.

The $C_4$− products from each zone (well gas processing, hydrocarbon synthesis and hydroconversion) can all be isolated using the first separation zone, which is more efficient than having multiple separation zones for $C_4$− products at several locations in the plant.

Any sulfur-containing compounds resulting from the additional processing of the hydrocarbon synthesis products in hydroconversion reactions can be routed to the same desulfurization zone used to treat the sulfur-containing compounds in the natural gas, before or after passage through the first separation zone. This eliminates the need for a second desulfurization zone, although another desulfurization zone can be present on site for other processes.

The process makes efficient use of a single desulfurization plant, without requiring the use of a second desulfurization plant. By processing the $C_4$− products from the natural gas, the hydrocarbon synthesis and/or the hydroconversion zone through the first separation zone and the desulfurization zone, the methane can be efficiently recycled throughout the process.

In addition to methane, natural gas includes some heavier hydrocarbons (mostly $C_2$–$C_5$ paraffins) and other impurities, e.g., mercaptans and other sulfur-containing compounds, carbon dioxide, nitrogen, helium, water and non-hydrocarbon acid gases. Natural gas fields also typically contain a significant amount of $C_5$+ material (known as a "natural gas condensate"), which is liquid at ambient conditions. Methane-rich and, optionally, LPG and natural gas condensate fractions are isolated from the natural gas.

Methods for removing methane from a paraffin fraction are well known to those of skill in the art. Suitable methods include absorption, refrigerated absorption, adsorption and condensation at cryogenic temperatures down to about −175° F. Demethanizer columns, which include one or more distillation towers, are typically used to separate methane and other more volatile components from ethane and less volatile components. Demethanizers are described, for example, in U.S. Pat. No. 5,960,643 to Kuechler et al. and C. Collins, R. J. J. Chen and D. G. Elliot, "Trends in NGL Recovery for Natural and Associated Gases", GasTech, Ltd. of Rickmansworth, England, pages 287–303, GasTech LNG/LPG Conference 84.

Although feedstocks including both methane and ethane can be used to generate syngas, less coking is observed when methane alone is used. For this reason, the majority of the ethane in the feedstock is preferably removed from the methane-rich fraction before the syngas is generated. The ethane is also preferably not present to a significant extent (preferably less than five percent by volume) in any LPG fractions which are collected. The ethane can be removed, for example, using deethanizer columns. In one embodiment, the ethane is sent to an ethane cracker to form ethylene.

After the methane-rich fraction is isolated and the bulk of the ethane removed, LPG and natural gas condensate fractions can optionally be isolated from the remaining $C_3$+ product stream. For example, propane, n-butane and isobutane can be isolated, for example, in a turbo-expander, and desulfurized to provide an LPG fraction. The remaining products (natural gas condensate) are primarily $C_5$+ hydrocarbons, which can be treated to remove sulfur, optionally isomerized and used, for example, in gasoline compositions.

Alternatively, C4− hydrocarbons can be separated from the $C_5$+ hydrocarbons using other known techniques, for example, via solvent extraction or via adsorption using an adsorbent such as FLEXSORB®. The order in which demethanization, deethanization and depropanization occur can vary, so long as a methane-rich feed suitable for use in a syngas generator and, optionally, suitable LPG and natural gas condensate fractions are obtained.

Other feedstreams from various petroleum refining operations, including the distillation and/or cracking of crude oil, also provide a fraction containing $C_{1-5}$ paraffins. For example, cracked gas feedstreams include hydrogen and $C_1$–$_6$ paraffins and refinery waste gas includes hydrogen and $C_1$–$_5$ paraffins. Methane-rich streams suitable for syngas generation and, optionally, for LPG or $C_5$+ fractions can optionally be obtained from these streams as well, alone or in combination with natural gas streams, although natural gas alone is preferred. If methane and/or ethane from these streams is sent to the syngas generator, any olefins, alkynes, $C_3$+ paraffins and/or heteroatom-containing compounds should be removed. Olefin and alkyne impurities are likely to be present in gas streams from refinery or petrochemical plants, as well as from C4− fractions from the hydrocarbon synthesis, and can be removed, for example, by hydrogenation. Sulfur impurities can be removed using means well known to those of skill in the art, for example extractive Merox, hydrotreating, adsorption, etc. Nitrogen-containing impurities can also be removed using means well known to those of skill in the art. Hydrotreating is the preferred means for removing these and other impurities.

The LPG fraction can be treated in a similar manner to remove olefin, alkyne and heteroatom impurities. Preferably, desulfurization is performed at a single desulfurization zone.

Methane (and/or ethane and heavier hydrocarbons) can be desulfurized and sent through a conventional syngas generator to provide synthesis gas. Typically, synthesis gas contains hydrogen and carbon monoxide, and may include minor amounts of carbon dioxide, water, unconverted hydrocarbons and various other impurities.

The presence of sulfur, nitrogen, halogen, selenium, phosphorus and arsenic contaminants in the syngas is undesirable. For this reason, it is preferred to remove sulfur and other contaminants from the feed before performing the Fischer-Tropsch chemistry or other hydrocarbon synthesis. Means for removing these contaminants are well known to those of skill in the art. For example, ZnO guard beds are preferred for removing sulfur impurities. Means for removing other contaminants are well known to those of skill in the art.

Fischer-Tropsch synthesis is a preferred hydrocarbon synthesis, although other hydrocarbon syntheses, for example, conversion of syngas to methanol and subsequent conversion of methanol to higher molecular weight products can also be used.

Liquid and gaseous products formed in the Fischer-Tropsch synthesis process, include principly paraffinic hydrocarbons with smaller amounts of olefins and oxygenates such as alcohols and organic acids. The products are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about from 300° to 700° F. (149° to 371° C.) preferably about from 400° to 550° F. (204° to 228° C.); pressures of about from 10 to 600 psia, (0.7 to 41 bars) preferably 30 to 300 psia, (2 to 21 bars) and catalyst space velocities of about from 100 to 10,000 cc/g/hr., preferably 300 to 3,000 cc/g/hr.

The products may range from $C_1$ to $C_{200}$+ with a majority in the $C_5$–$C_{100}$ range. The reaction can be conducted in a variety of reactor types for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079, also completed incorporated herein by reference for all purposes.

Suitable Fischer-Tropsch catalysts comprise on or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La2O_3$, MgO, and $TiO_2$, promoters such as ZrO2, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but nonlimiting examples may be found, for example, in U.S. Pat. No. 4,568,663.

When the Fischer-Tropsch reaction is carried out in a slurry bed reactor, the products generally include a tail gas fraction and at least one $C_5$+ liquid reaction product. In one embodiment, two or more liquid reaction product, such as a low-boiling liquid product and/or a high boiling wax fraction, may be produced. The tail gas fraction generally comprises unreacted CO and $H_2$ and $C_4$− products. The low-boiling liquid product includes hydrocarbons boiling below about 650° F. (i.e. $C_5$-650° F. hydrocarbons, with a substantial portion being $C_5$–$C_{20}$ products). The high boiling wax fraction includes hydrocarbons boiling above about 650° F., and often up to boiling point temperatures of 1300° F. and above (nominally containing. The fraction boiling above about 650° F. (the wax fraction) contains primarily linear paraffins in the $C_{20}$ to $C_{200}$ range.

One or more of the liquid products recovered from a Fischer-Tropsch process may be separated using, for example, a high pressure and/or lower temperature vapor-liquid separator or low pressure separators or a combination of separators.

The tail gas fraction (including $C_4$− hydrocarbons) is preferably sent to the first separation zone to obtain an additional methane-rich fraction for recycle through the syngas generator and/or an additional LPG fraction. The tail gas fraction may contain a significant amount of olefins. When the specifications for LPG requires low olefin concentration, hydrogenation of the tail gas fraction, or an LPG fraction derived therefrom may be necessary. This hydrogenation can occur before the fraction is sent to the first separation zone, or after passage through the first separation zone.

The relative amounts of the tail gas fraction, low-boiling liquid fraction and highboiling wax fraction formed in the Fischer-Tropsch synthesis step can be controlled by judicious selection of catalysts and reaction conditions. Catalysts with low chain growth probabilities (for example, an alpha value below about 0.6) favor formation of relatively low molecular weight products, for example, $C_{2-8}$ products, but tend to produce a relatively large amount of methane. The yield in $C_{3-5}$ hydrocarbons suitable for use in preparing LPG fractions may be relatively high, but the chemistry may be less preferred because of the relatively high amount of methane formed, which must be recycled.

Catalysts with relatively high chain growth probabilities (for example, an alpha value above about 0.8) favor formation of wax and other heavy products, and tend to form relatively low amounts of methane. The wax can be treated, for example, by hydrocracking, to provide a variety of products, including hydrocarbons, useful for forming LPG fractions as well as hydrocarbons in the distillate fuel range. Selection of an appropriate set of conditions for performing the Fischer-Tropsch reaction depends in large part on market conditions, and these conditions can be adjusted, as appropriate, to provide a suitable product stream for hydroconversion to form useful commercial products.

At least a portion of the liquid fractions from the Fischer-Tropsch reaction are subjected to hydroconversion reactions (i.e. hydrogenation, hydrotreating, hydroisomerization, hydrocracking and the like). The low-boiling liquid fraction, includes mostly linear hydrocarbons, and may be subjected to isomerization conditions to improve the pour point and/or hydrotreating to remove, for example, oxygenates (e.g. alcohols, organic acids) or olefins or both. The high-boiling wax fraction, which is highly paraffinic, may be subjected to hydrocracking conditions in order to isomerize and crack the wax to produce high quality fuel products and optionally lubricating oil base stocks. The $C_4$− fraction isolated from the hydroconversion products contains a small amount of sulfur, principally in the form of $H_2S$, which are producing during hydroconversion. The sulfur may originate from a number of sources, including sulfur stripped from a sulfided catalyst used for hydroconversion, or from sulfur added to the Fischer-Tropsch product prior to hydroconversion for facilitating the hydroconversion process. The sulfur-containing $C_4$− fraction is treated in a treatment zone, either separately or in combination with a well gas. A desulfurized methane-rich fraction, a sulfur rich fraction (containing substantial amounts of $H_2S$), and a $C_3$+ hydrocarbon fraction are isolated from the treatment zone. The relative amounts of $C_4$− products to fuel products from the hydroconversion process is generally determined, for example, by the choice of catalyst used for hydroconversion and the hydroconversion reaction conditions. A more selective catalyst generally produces a higher proportion of fuel products, as does milder reaction conditions.

Typical hydroconversion conditions vary over a wide range. In general, the overall LHSV is about 0.25 to 20 $hr^{-1}$, preferably about 0.5 to 10 $hr^{-1}$. The total pressure is greater than 200 psia, preferably in the range from 500 psia to 3500 psia. Hydrogen recirculation rates are typically greater than 50 SCF/Bbl, and are preferably between 300 and 6000 SCF/Bbl. Temperatures in the range from 300° F. to 850° F., preferably ranging from 400° F. to 800° F.

Suitable catalysts include noble metals from Group VIIIA, such as platinum or palladium on an alumina or siliceous matrix, and Group VIIIA and Group VIB metals, such as nickel-molybdenum or nickel-tin on an alumina or siliceous matrix. U.S. Pat. No. 3,852,207 describes a suitable noble metal catalyst and reaction conditions. Other suitable catalysts are described, for example, in U.S. Pat. Nos. 4,157,294 and 3,904,513. Non-noble metals (such as nickel-molybdenum) are usually present in the final catalyst composition as oxides, or possibly as sulfides, when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts include in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e., molybdenum and tungsten can be combined with the refractory oxide by impregnation, co-mulling or co-precipitation.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so-called ultra stable zeolite Y and high structural silica:alumina ratio zeolite Y such as that described in U.S. Pat. Nos. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate, and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799. Mesoporous molecular sieves can also be used, for example the M41S family of materials (*J. Am. Chem. Soc.* 1992, 114, 10834–10843), MCM-41 (U.S. Pat. Nos. 5,246,689, 5,198,203 and 5,334,368), and MCM-48 (Kresge et al., *Nature* 359:710 (1992)). The contents of each of the patents and publications referred to above are hereby incorporated by reference in its entirety.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

As used herein, the term "hydrotreating" is given its conventional meaning and describes processes that are well known to those skilled in the art. Hydrotreating refers to a catalytic process, usually carried out in the presence of free hydrogen, in which the primary purpose is the desulfurization and/or denitrification of the feedstock. In addition, oxygen is removed from oxygen-containing hydrocarbons (e.g., alcohols, acids, etc.). The sulfur is generally converted to hydrogen sulfide, the nitrogen is generally converted to ammonia, and the oxygen is converted to water, and these can be removed from the product stream using means well known to those of skill in the art. Although sulfur impurities are typically not present in Fischer-Tropsch products, they can be introduced when the products are contacted with pre-sulfided catalysts.

Generally, in hydrotreating operations, cracking of the hydrocarbon molecules, i.e., breaking the larger hydrocarbon molecules into smaller hydrocarbon molecules, is minimized; however, unsaturated hydrocarbons are either fully or partially hydrogenated.

Catalysts used in carrying out hydrotreating operations are well known in the art. See, for example, U.S. Pat. Nos. 4,347,121 and 4,810,357 for general descriptions of hydrotreating and typical catalysts used in hydrotreating processes. A hydrotreating catalyst useful in the present process comprises one or more of a Group VI metal, such as molybdenum or tungsten or a Group VIII metal such as nickel or tungsten on a oxide matrix support, including one or more of alumina, silica and magnesia. A zeolite such as a Y-type zeolite, including an ultlra-stable Y type zeolite, may also be included. An example nickel containing catalyst may be used with or without presulfiding. Typically, catalysts comprising a Group VI metal are presulfuided prior to use for hydrotreating.

Furthermore, more than one catalyst type may be used in the reactor. The different catalyst types can be separated into layers or mixed. Typical hydrotreating conditions vary over a wide range. In general, the overall LHSV is about 0.25 to 20, preferably about 0.5 to 10. The hydrogen partial pressure is greater than 200 psia, preferably ranging from about 500 psia to about 2000 psia. Hydrogen recirculation rates are typically greater than 50 SCF/Bbl, and are preferably between 300 and 6000 SCF/Bbl. Temperatures range from about 300° F. to about 750° F., preferably ranging from 400° F. to 750° F.

Typical hydroisomerization conditions are well known in the literature and can vary widely. Isomerization processes are typically carried out at a temperature between 200° F. and 800° F., preferably 400° F. to 750° F., with a liquid hourly space velocity between 0.1 and 5, preferably between 0.25 and 2.50. Hydrogen is employed such that the mole ratio of hydrogen to hydrocarbon is between 1:1 and 20:1. Catalysts useful for isomerization processes are generally bifunctional catalysts that include a dehydrogenation/hydrogenation component, an acidic component, and an oxide matrix material. Useful hydrogenation components for the present hydroisomerization catalyst may comprise one or more base metal compoents, such as nickel, cobalt, tungsgten and molybdenum, or one or more platinum group metals, especially one or more of platinum or palladium. Example acidic components include one or more of silica alumina (optionally with added phosphorous) and a zeolite, such as a Y-type zeolite, including an ultrastable Y type zeolite. The catalyst may also contain a halogen component such as fluorine or chlorine. Example oxide matrix materials include alumina, silica, magnesia, titania, and combinations thereof.

A preferred supported catalyst has surface areas in the range of about 180–400 $m^2$/gm, preferably 230–350 $m^2$/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

The hydroisomerization catalyst(s) can be prepared using well known methods, e.g., impregnation with an aqueous salt, incipient wetness technique, followed by drying at about 125–150° C. for 1–24 hours, calcination at about 300–500° C. for about 1–6 hours, reduction by treatment with a hydrogen or a hydrogen-containing gas, and, if desired, sulfiding by treatment with a sulfur-containing gas, e.g., $H_2S$ at elevated temperatures. The catalyst will then have about 0.01 to 10 wt % sulfur. The metals can be composited or added to the catalyst either serially, in any order, or by co-impregnation of two or more metals.

Hydrocracking conditions and catalysts are selected for reducing the molecular weight of the Fischer-Tropsch products. When synthesis products boiling above 650° F. are hydrocracked, a substantial amount of hydrocracked products boiling in the fuel range (i.e. an upgraded $C_5$-650° F. product) with lesser amounts of $C_4$– products. Unreacted or partially 650° F.+ synthesis products may be recycled for additional cracking, or isolated for use elsewhere (i.e. for lube base oil products). Hydrocracking catalysts may contain either base metal catalysts (e.g. one or more of nickel, cobalt, molybdenum or tungsten) or platinum group metal catalysts (one or more of platinum or palladium) and an acidic component on an oxide matrix material., Hydrocracking refers to a catalytic process, usually carried out in the presence of free hydrogen over zeolites or other acidic catalysts at relatively high temperatures and/or pressures, in which the cracking of the larger hydrocarbon molecules is a primary purpose of the operation. Desulfurization and/or denitrification of the feed stock usually will also occur.

Catalysts used in carrying out hydrocracking operations are well known in the art, and it should not be necessary to describe them in detail here. See, for example, U.S. Pat. Nos. 4,347,121 and 4,810,357 for general descriptions of hydrotreating, hydrocracking, and typical catalysts used in each process.

The natural gas and the methane-rich fractions isolated from the natural gas, as well as the products of the hydroconversion reactions, can be upgraded to remove sulfur and other undesirable materials. Methods for removing sulfur impurities are well known to those of skill in the art, and include, for example, extractive Merox, hydrotreating, adsorption, etc. Nitrogen-containing impurities can also be removed using means well known to those of skill in the art. Hydrotreating is the preferred means for removing these and other impurities.

Preferably, any sulfur-containing compounds resulting from the hydroconversion of the Fischer-Tropsch products are treated along with the sulfur-containing compounds in the natural gas in one desulfurization zone. This eliminates the need for a second desulfurization zone, at least with respect to those sulfur-containing compounds present in the C4– fractions. The desulfurization zone can be scaled up as desired to accommodate the additional capacity.

Since most of the sulfur-containing compounds in the natural gas and hydroconversion products are relatively volatile, they will most likely be found in the C4– fractions. The desulfurization zone can be scaled up from its normal size to accommodate the additional sulfur removal resulting from the hydroconversion.

In an example embodiment of the present invention illustrated in FIG. 1, well gas (12) is sent to a treatment zone comprising a first separation zone (10) and a desulfurization zone (20) to provide a desulfurized methane-rich stream (22), a sulfur rich fraction (24) and a $C_3$+ hydrocarbon fraction (26). The methane-rich stream is combined with an oxygen containing stream (32) and sent through a syngas generator (30) to form syngas (34), which is sent to a Fischer-Tropsch reactor (40). The products of the Fischer-Tropsch reaction (42) are sent to a second separation zone (50) where the $C_4$– products (52) are recycled through the first separation zone (10) and the $C_5$+ products (54) are subjected to hydroconversion (60). The fuel product (72) of the hydroconversion reaction is isolated in (70), and the sulfur containing $C_4$– stream (74) recycled to the treatment zone.

In one embodiment, the $C_4$– fractions from the Fischer-Tropsch synthesis and also from the hydroconversion reactions are combined and treated together, alone or in combination with the $C_4$– fractions from the natural gas or other feedstreams.

While the present invention has been described with reference to specific embodiments, this application is intended to cover those various changes and substitutions that may be made by those skilled in the art without departing from the spirit and scope of the appended Claims.

That which is claimed is:

1. A process for providing a desulfurized hydroprocessed hydrocarbon product from Fischer-Tropsch synthesis, the process comprising;

a) treating a well gas in a treatment zone and isolating a desulfurized methane-rich fraction, a sulfur rich fraction and a $C_3$+ hydrocarbon fraction, b) converting the desulfurized methane-rich fraction to syngas, c) subjecting the syngas to hydrocarbon synthesis conditions, d) subjecting at least one $C_5$+ liquid reaction product from the hydrocarbon synthesis to hydroconversion conditions and producing a sulfur-containing $C_4$– fraction and an upgraded $C_5$+ fraction, and e) treating the sulfur-containing $C_4$– fraction in the treatment zone of step a.

2. The process of claim 1 wherein the sulfur-containing $C_4$– fraction is combined with the well gas and the combined stream is separated to isolate the desulfurized methane-rich fraction.

3. The process of claim 1, wherein the step of isolating a desulfurized methane-rich fraction from a well gas comprises;

a) combining the sulfur-containing $C_4$– fraction and the well gas and desulfurizing the combined stream; and b) separating the desulfurized combined stream in a separation zone and isolating the desulfurized methane-rich fraction.

4. The process of claim 1, wherein the hydrocarbon synthesis conditions comprise Fischer-Tropsch synthesis conditions.

5. The process of claim 4, wherein the Fischer-Tropsch synthesis conditions favor formation of waxy products.

6. The process of claim 1, wherein the $C_5$+ liquid reaction product of step d) to be hydroconverted is substantially a 650° F.+ product.

7. The process of claim 1, wherein the $C_5$+ reaction product of step d) is substantially a $C_5$-650° F. product.

8. The process of claim 1, wherein the hydroconversion conditions include one or more of hydrotreating, hydroisomerization or hydrocracking conditions.

9. The process of claim 8, wherein the hydroconversion conditions comprise hydrocracking to form a products stream comprising a $C_4$− fraction and a $C_5$-650° F. fraction.

10. The process of claim 1, wherein $C_4$− fraction is isolated from the products stream and combined with the well gas for treatment in the treatment zone.

11. The process of claim 1, wherein the hydroconversion conditions include contacting the $C_5$+ hydrocarbon products with hydrogen in the presence of a sulfided catalyst which contains at least one Group VI metal component and at least one Group VIII metal component at a temperature in the range from 300° F. to 850° F. of and a pressure in the range from 500 psia to 3500 psia.

12. A process for providing a desulfurized hydroprocessed hydrocarbon product from Fischer-Tropsch synthesis, the process comprising;

a) treating a well gas in a treatment zone and isolating a desulfurized methane-rich fraction, a sulfur rich fraction and a $C_3$+ hydrocarbon fraction, b) converting the desulfurized methane-rich fraction to syngas, c) subjecting the syngas to hydrocarbon synthesis conditions, d) subjecting at least one $C_5$+ liquid reaction product from the hydrocarbon synthesis to hydroconversion conditions, which comprises contacting the $C_5$+ hydrocarbon products with hydrogen in the presence of a sulfided catalyst which contains at least one Group VI metal component and at least one Group VIII metal component at a temperature in the range from 300° F. to 850° F. of and a pressure in the range from 500 psia to 3500 psia, and producing a sulfur-containing $C_4$− fraction and an upgraded $C_5$+ fraction, and e) desulfurizing the sulfuir-containing $C_4$− fraction in the treatment zone of step a.

* * * * *